US005890931A

United States Patent [19]

Ittah et al.

[11] Patent Number: 5,890,931

[45] Date of Patent: Apr. 6, 1999

[54] POLARIZING SYSTEM FOR ELECTRICAL CONNECTORS

[75] Inventors: Jean Ittah, Villeneuve la Garenne; Olivier Plessis, Voisin le Bretonneux, both of France

[73] Assignee: Connecteurs Cinch, Montigny le Bretonneux, France

[21] Appl. No.: 866,215

[22] Filed: May 30, 1997

[30] Foreign Application Priority Data

Jun. 11, 1996 [FR] France ..... 96 07229

[51] Int. Cl.[6] ..... H01R 13/64

[52] U.S. Cl. ..... 439/679; 439/677

[58] Field of Search ..... 439/677, 681

[56] References Cited

U.S. PATENT DOCUMENTS

| | | | |
|---|---|---|---|
| 4,448,467 | 5/1984 | Weidler | 439/681 |
| 4,900,261 | 2/1990 | Gentry et al. | 439/680 |
| 4,913,665 | 4/1990 | Sacksen | 439/677 |
| 5,425,650 | 6/1995 | Maeda | 439/680 |

FOREIGN PATENT DOCUMENTS

| | | |
|---|---|---|
| 104755 | 4/1984 | European Pat. Off. . |
| 262432 | 4/1988 | European Pat. Off. . |
| 2449342 | 9/1980 | France . |
| 497134 | 5/1934 | Germany . |

OTHER PUBLICATIONS

One French Search Report issued with French Application No. 96.07229 and Annex.

*Primary Examiner*—Steven L. Stephan
*Assistant Examiner*—T C Patel
*Attorney, Agent, or Firm*—Greenblum & Bernstein, P.L.C.

[57] ABSTRACT

A system is provided for polarizing electrical connectors of generally parallelepipedal shape and of the type having a male housing part adapted to be inserted in a skirt of a female housing part, one of these parts having along one wall at least one longitudinal tongue and the other of these parts having at least one corresponding groove which receives the tongue when the male housing part is fitted into the skirt of the female housing part. The free end of the tongue terminates in a bevel, the free edge of the skirt terminates in a corresponding bevel and the bevels on the tongue and on the free edge of the skirt are oriented so that, if the male housing part is not offered up in the correct position for insertion into the skirt, the bevels bear one against the other and tend to close up the opening of the skirt.

3 Claims, 3 Drawing Sheets

POLARIZING SYSTEM FOR ELECTRICAL CONNECTORS

BACKGROUND OF THE INVENTION

1. Field of the Invention

The invention concerns the polarizing of electrical connectors.

The invention concerns connectors having a male housing member having a series of electrical contact members and a female housing member having electrical contact members complementary to those of the male housing member.

A polarizing system is usually provided in such connectors so that the male housing member can be inserted into the skirt of the female housing member in only one position.

2. Description of the Prior Art

There are many polarizing systems, some of which provide a groove in one of the housing members and a tongue on the corresponding wall of the other housing member so that, in theory, the two housing members can be inserted one within the other only if the tongue is lined up with the groove. Systems of this kind are also designed to prevent insertion of a non-matching male member into the skirt of the female member.

The current trend is to miniaturize electrical connections with the result that connectors are very often very small in size. The grooves and the tongues are therefore very small and, given the small thickness of the plastics material walls in and on which they are formed, it has been found that the male member can be forcibly inserted into the skirt of the female member even if the two members are not offered up in the correct position.

One aim of the present invention is to remedy this drawback.

SUMMARY OF THE INVENTION

A system in accordance with the invention for polarizing electrical connectors of generally parallelepipedal shape is of the type having a male housing member adapted to be inserted in a skirt of a female housing member, one of the members having along one wall at least one longitudinal tongue and the other member having at least one corresponding groove adapted to receive the tongue when the male housing member is fitted into the skirt of the female housing member, in which the free end of the tongue terminates in a bevel, the free edge of the skirt terminates in a corresponding bevel, and the bevels on the tongue and on the free edge of the skirt are oriented so that, if the male housing member is not offered up in the correct position for insertion into the skirt, the bevels bear one against the other and tend to close up the opening of the skirt.

With this arrangement, if the housing members are not offered up in the correct position for insertion one within the other, they cannot be assembled, even forcibly.

In accordance with one constructional feature, the male housing member has a tongue on two opposite lateral walls, the tongues extending longitudinally and being offset relative to a median longitudinal plane of the male housing member, and the female housing member has two corresponding grooves on two side walls of the skirt, the free edge of the skirt adjacent the grooves terminating in a bevel.

Finally, in accordance with a final feature, the tongues on the two opposite walls of the male housing member are offset in the heightwise direction relative to each other and the female housing member has two corresponding grooves in two side walls of the skirt, the free edge of the skirt adjacent the grooves terminating in a bevel.

The invention will now be described in more detail with reference to one specific embodiment shown by way of example only in the accompanying drawings.

DETAILED DESCRIPTION OF THE PREFERRED EMBODIMENT

Figure 1:
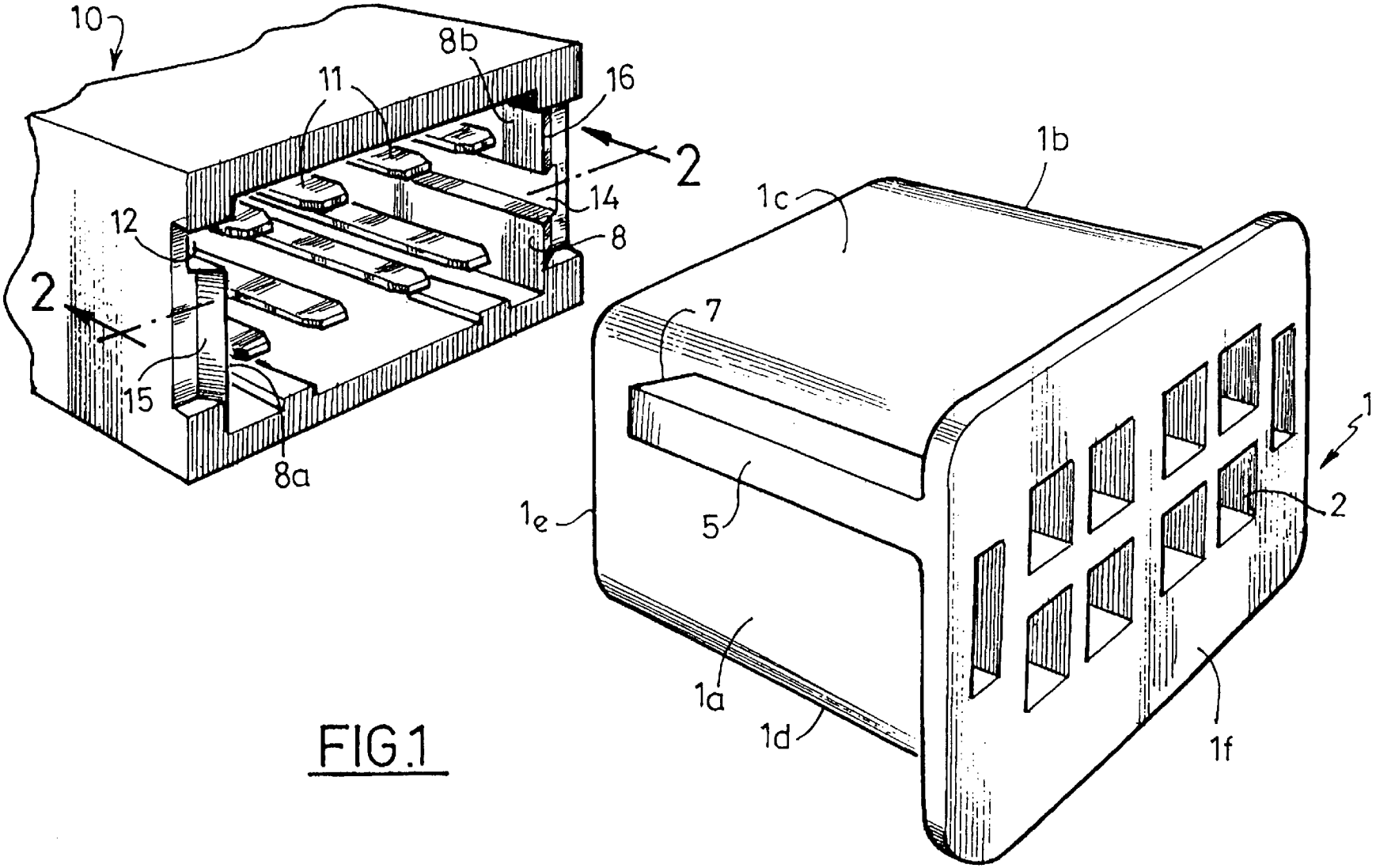
FIG. 1 is an exploded perspective view of a connector polarized in accordance with the invention.

FIG. 1 shows a male housing member 1 having a series of passages 2 each adapted to receive an electrical contact member. The housing member 1 is generally parallelepipedal in shape with four side walls 1*a*, 1*b*, 1*c* and 1*d*, a front wall 1*f* and a back wall 1*e*.

A tongue 5 extends longitudinally along the side wall 1*a*, in the vicinity of the wall 1*c*. A tongue 6 on the wall 1*b* is parallel to the tongue 5 but offset from the latter in the heightwise direction.

Figure 2:
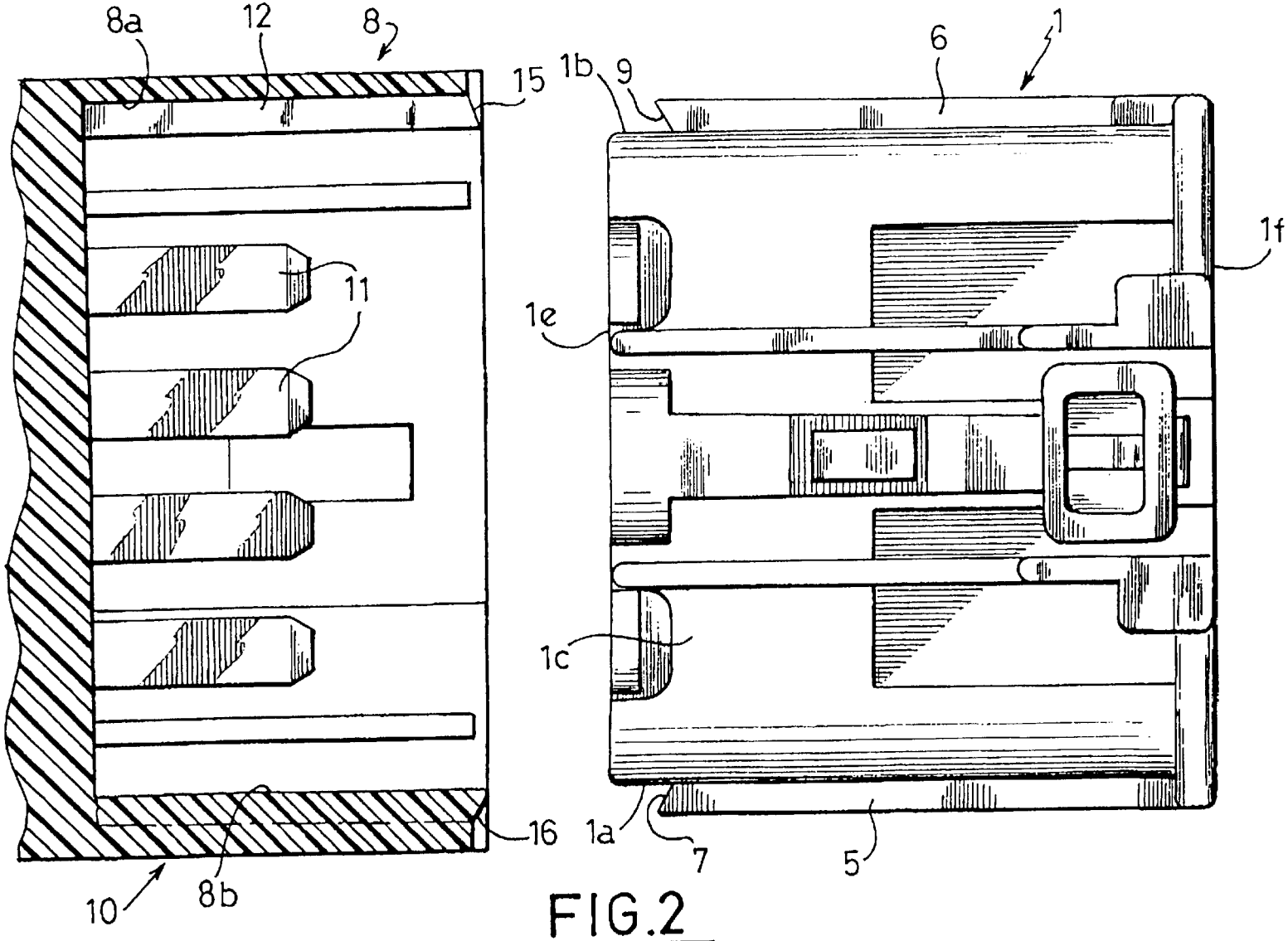
FIG. 2 is an elevation view showing the male housing member offered up to the female housing member in an incorrect position, the female housing member being shown in section taken along the line 2—2 in FIG. 1.

As can be seen in FIG. 2, the ends of the tongues 5 and 6 towards the wall 1*e* terminate in respective bevels 7 and 9 so as to form a re-entrant angle on the side facing the corresponding wall.

The housing member 1 is designed to be inserted into the skirt 8 of a female housing member 10 that has inside it male electrical contact members 11 adapted to be inserted into the passages 2.

One inside wall 8*a* of the skirt 8 includes a groove 12 designed to receive the tongue 5 and the internal wall 8*b* opposite the wall 8*a* includes a groove 14 into which the tongue 6 is inserted.

In the position shown in FIG. 1, the male housing member 1 can be inserted correctly into the skirt 8.

The free edge of the wall 8*a* terminates in a bevel 15 and the free edge of the wall 8*b* terminates in a bevel 16.

The bevels 15 and 16 are complementary to the bevels 7 and 9.

Figure 3:
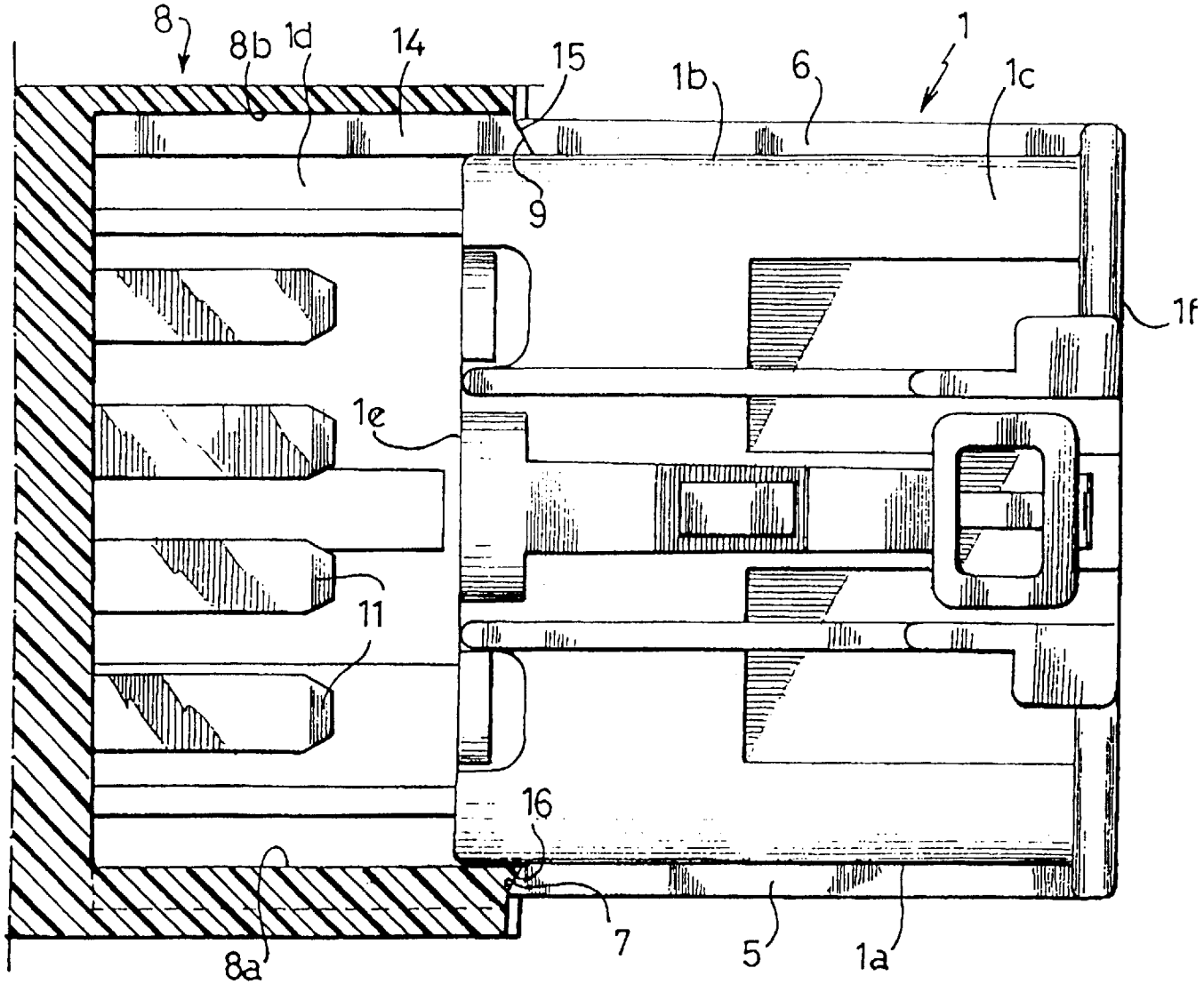
FIG. 3 is a view similar to FIG. 3 showing how the polarizing system tends to oppose assembly if the connector members are not inserted correctly.

If the housing member 1 is offered up at 180° to the normal insertion position (see FIGS. 2 and 3), the bevels 9, 15 and 7, 16 are inserted one within the other and therefore tend to close up the walls 8*a* and 8*b* so that it is impossible to insert the member 1 into the skirt 8, even forcibly.

In the embodiment shown, the tongues are carried by the male member 1 and the grooves are formed in the skirt of the female member 10. The tongues could equally well be in the skirt and the grooves in the lateral walls of the male member, in which case the free end of the male member would incorporate a bevel.

Of course, the invention is not limited to the embodiment shown and that has just been described. Many modifications of detail can be made thereto without departing from the scope of the invention.

There is claimed:

1. A system for polarizing electrical connectors of generally parallelepipedal shape and having a male housing member adapted to be inserted in a skirt of a female housing member, one of said members having along one wall at least one longitudinal tongue and the other of said members having at least one corresponding groove adapted to receive said tongue when said male housing member is fitted into said skirt of said female housing member, wherein the free end of said tongue terminates in a bevel, the free edge of said skirt terminates in a corresponding bevel, and said bevels on said tongue and on said free edge of said skirt are oriented so that, if said male housing member is not offered up in the correct position for insertion into said skirt, said bevels bear one against the other and tend to close up the opening of said skirt.

2. The system for polarizing electrical connectors of generally parallelepipedal shape claimed in claim 1 wherein said male housing member has a tongue on two opposite lateral walls, said tongues extending longitudinally and being offset relative to a median longitudinal plane of said male housing member, and said female housing member has two corresponding grooves on two side walls of said skirt, said free edge of said skirt adjacent said grooves terminating in a bevel.

3. A system for polarizing electrical connectors of generally parallelepipedal shape claimed in claim 2 wherein said tongues on said two opposite walls of said male housing member are offset in the heightwise direction relative to each other and said female housing member has two corresponding grooves in two side walls of said skirt, the free edge of said skirt adjacent said grooves terminating in a bevel.

* * * * *